US006139341A

United States Patent [19]

Hun

[11] Patent Number: 6,139,341

[45] Date of Patent: Oct. 31, 2000

[54] UNIVERSAL ADAPTER EQUIPPED WITH RETRACTABLE PINS

[75] Inventor: Timothy Hun, Hualien, Taiwan

[73] Assignee: Taiwan Semiconductor Manufacturing Company, Ltd, Hsinchu, Taiwan

[21] Appl. No.: 09/203,959

[22] Filed: Dec. 2, 1998

[51] Int. Cl.[7] ..... H01R 29/00

[52] U.S. Cl. ..... 439/172; 439/173

[58] Field of Search ..... 439/171, 170, 439/172, 174, 52, 620, 638, 651, 173

[56] References Cited

U.S. PATENT DOCUMENTS

| | | | |
|---|---|---|---|
| 2,538,296 | 1/1951 | Crocker | 439/172 |
| 3,025,486 | 3/1962 | Falconer | 439/103 |
| 4,626,052 | 12/1986 | Rumble | 439/173 |
| 4,728,163 | 3/1988 | Kittinger et al. | 439/172 |
| 5,423,690 | 6/1995 | Selker et al. | 439/172 |
| 5,474,464 | 12/1995 | Drewnicki | 439/172 |
| 5,513,998 | 5/1996 | Kim | 439/170 |

FOREIGN PATENT DOCUMENTS 2414203 10/1975 Germany .

*Primary Examiner*—Brian Sircus
*Assistant Examiner*—Michael C. Zarroli
*Attorney, Agent, or Firm*—Tung & Associates

[57] ABSTRACT

A universal adapter that is equipped with retractable pins such that RS232 type of connectors having different numbers of pins or sockets can be connected together. It is further disclosed a method for utilizing such universal adapters by retracting at least one of the retractable pins such that a smaller female connector can be inserted into a larger male connector by retracting a suitable number of pins in the male connector to allow the insertion. The apparatus allows the connection of a 25-pin male connector to any suitable number of sockets in a female connector, i.e. most likely to a 15-socket or a 9-socket female connector. The apparatus enables the use of a single universal adapter in place of a large number of adapters that is conventionally required for making connections between connectors of dissimilar numbers of pins or sockets.

22 Claims, 2 Drawing Sheets

UNIVERSAL ADAPTER EQUIPPED WITH RETRACTABLE PINS

FIELD OF THE INVENTION

The present invention generally relates to a universal adapter for connecting multi-pin connectors that have different numbers of pins and sockets and more particularly, relates to a universal adapter for connecting multi-pin connectors hat is equipped with retractable pins such that connectors having different numbers of pins and sockets can be connected together.

BACKGROUND OF THE INVENTION

Multi-pin connectors have been widely used in electronic applications. One of such widely used multi-pin connectors, designated as the RS232 type, have been used in making electrical connections between computers and their peripheral equipment such as printers, display screens, keyboards. etc.

Typical RS232 multi-pin connectors have different numbers of pins in a male connector or different numbers of sockets in a female connector. For instance, the more popularly used male connectors are the 9-pin, the 15-pin and the 25-pin connectors. Similarly, the more popularly used female connectors have 9 sockets, 15 lockets or 25 sockets. The most widely used multi-pin connector may be the 25-pin type connector since it has the most electrical leads and thus is the most versatile for establishing electrical connections.

In electronic applications, frequently a male connector which has x pins needs to be connected to a female connector of y sockets. When such need occurs, an adapter must be used to enable the connection between the different numbers of pins and sockets. For instance, an adapter is required for making connections from 9 pins to 9 pins, 9 pins to 15 pins, 9 pins to 15 sockets, 9 pins to 25 sockets, 9 pins to 25 pins, 9 sockets to 9 sockets, 9 sockets to 15 pins, 9 sockets to 15 sockets, 9 sockets to 25 pins, 9 sockets to 25 sockets, 15 pins to 15 pins, 15 pins to 25 sockets, 15 pins to 25 pins, 15 sockets to 15 sockets, 15 sockets to 25 pins, 15 sockets to 25 sockets, 25 pins to 25 pins, and 25 sockets. In the RS232 connector alone, there is a need for 18 different types of adapters in order to make all possible connections. It is therefore a formidable task to supply and keep stock of all different types of adapters to suit all occasions. It would be desirable if a single adapter can be designed that fits all RS232 connectors. In other words, a single adapter that can be used to switch all kinds of ports.

It is therefore an object of the present invention to provide an universal adapter that can be used for switching connectors having differed number of pins or sockets that does not have the drawbacks or shortcomings of the conventional adapters.

It is another object of the present invention to provide a universal adapter which enables electrical connections between male connector/male connector, female connector/female connector or male connector/female connector that have different numbers of pins or sockets.

It is a further object of the present invention to provide a universal adapter that is equipped with retractable pins such that any number of pins can be retracted into the adapter to accommodate female connectors that have different numbers of sockets.

It is another object of the present invention to provide a universal adapter that is equipped with retractable pins and latch rings to achieve a connection with an electronic device.

It is still another object of the present invention to provide a universal adapter that is equipped with retractable pins which can be operated by tabs connected to the pins.

It is yet another object of the present invention to provide a universal adapter that is equipped with retractable pins adapted for slidably engaging slot openings on the adapter housing operable by tabs connected to the retractable pins.

It is still another further object of the present invention to provide a method for connecting a male connector having n pins to a female connector having m sockets (where m<n)by utilizing a universal adapter equipped with retractable pins such that the female connector equipped with lesser number of sockets can be plugged into the male connector equipped with a larger number of pins by retracting at least one of the pins.

It is yet another further object of the present invention to provide a method for connecting an n-pins male connector to an m-sockets female connector by using a universal adapter equipped with retractable pins such that at least one of the n pins is electrically connected to at least one of the m sockets.

SUMMARY OF THE INVENTION

In accordance with the present invention, a universal adapter equipped with retractable pins and a method for using such a universal adapter to connect connectors having different numbers of pins or sockets are disclosed.

In a preferred embodiment, a universal adapter equipped with retractable pins can be provided which includes an adapter housing having a cavity therein adapted for holding n-pins at one end and n-sockets at an opposite end, at least n slot openings provided in the housing corresponding to the positions of the n pins, n tabs each connected to one of the n pins and slidably engaging one of the at least n slot openings such that at least one of the n pins is extended for making electrical connection with at least one socket in a female connector or retracted into the housing breaking connections with the at least one socket in the female connector, and at least one electrical conductor connecting at least one of the n pins to at least one of the n sockets in the opposite end of the adapter housing.

In the universal adapter equipped with retractable pins, the n may be 15 and the adapter may be used for connecting to a 15-socket female connector. The adapter may also be used for connecting to a 9-socket female connector when n is 25 and the adapter housing may be adapted for holding 25 pins in the housing. The adapter may be connected to a 25-socket female connector. The adapter may be connected to a 15-socket female connector, or the adapter may be connected to a 9-socket female connector.

In the universal adapter equipped with retractable pins, the adapter housing may have a front cover and a back cover defining a cavity contained therein. The n slot openings may be provided in the front cover of the adapter housing. The n slot openings may also be provided in the back cover of the adapter housing, or provided in both the front and the back cover of the adapter housing. The end tabs may further include frictional engagement means such that the at least one of n pins extended may be inserted into a corresponding female socket. The n tabs may further include frictional engagement means such that the at least one of n pins retracted remains in a retracted position when not making an electrical connection.

The present invention is further directed to a method for connecting a male connector which has n pins to a female connector which has n sockets wherein n is larger than m by the operating steps of first providing an adapter that includes an adapter housing which has a cavity therein adapted for holding n pins at one end and m sockets at an opposite end. At least n slot openings provided in the housing corresponding to the positions of the n pins, n tabs each connected to one of the n pins and slidably engaging one of the at least n slot openings such that at least one of the n pins is extended for making electrical communication with at least one socket in a female connector or retracted into the housing breaking connections with the at least one socket in the female connector. At least one electrical conductor connecting at least one of the n pins to at least one of the n sockets in the opposite end of the adapter housing, and then retracting into the housing of the adapter at least one of the n pins such that the female connector is inserted to intimately engage the end of the adapter housing that has n pins whereby at least one of the n pins engages at least one of the m sockets.

In the method for connecting a male connector having n pins to a female connector having m sockets where n is larger than m, n may be 25 and the adapter housing is adapted for holding 25 pins in the housing. The adapter may be adapted for connecting to a female connector that has less than 25 sockets. The adapter may also be adapted for connecting to a 15-socket female connector. The adapter may further be adapted for connecting to a 9-socket female connector.

In the method, n may be 15 and the adapter may be adapted for connecting to a female connector which has less than 15 sockets, or n may be 15 and the adapter may be adapted for connecting to a female connector that has 9 sockets. The method may further include the step of providing n slot openings in a front cover of the adapter housing, or the step of providing n slot openings in both a front cover and a back cover of the adapter housing. The method may still further include the step of equipping the n tabs with frictional engagement means for holding the at least one of n pins extended in place for inserting into a female socket. The method may further include the step of equipping the n tabs with frictional engagement means for holding the at least one of n pins retracted in place and not making electrical connection.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a universal adapter equipped with retractable pins that is capable of connecting together female connectors and male connectors that have a different number of pins and sockets. The universal adapter is constructed of an adapter housing equipped with n pins at one end and n sockets at an opposite end, not less than n slot openings in the housing positioned corresponding to the n pins, n tabs connected to the n pins for slidably engaging the n slot openings and optionally equipped with frictional engagement means, and at least one wiring connecting at least one of the n pins to at least one of the n sockets. The present invention universal adapter may further be constructed with n pins at one end and n pins at the opposite end for connecting to two female connectors.

The present invention further discloses a method for connecting a male connector that has n pins to a female connector that has m sockets where n is larger than m by first providing an universal adapter and then retracting into the housing of the adapter at least one of the n pins such that the female connector may be inserted to intimately engage the end of the adapter housing that has n pins whereby at least one of the n pins engages at least one of the m sockets.

Figure 1A:
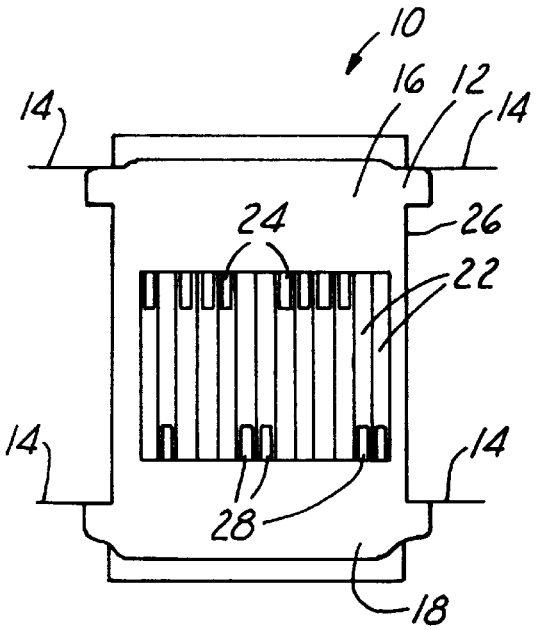
FIG. 1A is a plane view of the front cover of a present invention universal adapter equipped with 13 tabs and 13 slot openings.
Figure 1B:
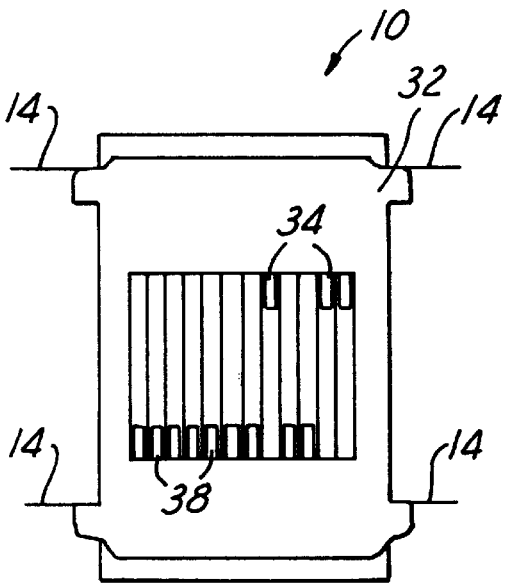
FIG. 1B is a plane view of the backside of a present invention universal adapter equipped with 12 tabs and 12 slot openings.

In a preferred embodiment, a universal adapter which has a 25-pin male connector at one end and a 25-socket female connector at the opposite end is provided. A plane view of the front side and the backside of the universal adapter is shown in FIGS. 1A and 1B, respectively. In FIG. 1A, the universal adapter 10 is shown with the front side 12 on top. On the universal adapter 10, four latch rings 14 are provided for latching onto, for instance, an electronic device at the first end 16 and to a male connector (not shown) at the second socket end 18. In the top cover 12, slot openings 22 are provided for operating the retractable pins (not shown) contained in the adapter 10.

As shown in FIG. 1A, a total of 13 slot openings 22 are provided for operating the 13 retractable pins. Each of the retractable pins (not shown) is operated by a tab 24 that is connected to the retractable pin. For instance, in the geometry shown in FIG. 1A, the top positions of the tabs 24 indicate a position wherein the retractable pin is extended, i.e., in an "ON" position. Similarly, the tabs 24 that are shown at the bottom of the slot openings 22 are indicative of retractable pins at an "OFF" position with the retractable pins fully retracted into the housing 26 of the adapter 10.

Figure 2A:
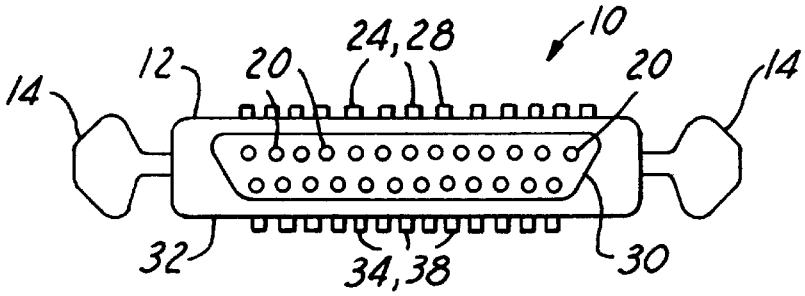
FIG. 2A is an end view of the present invention universal adapter showing 25 pins.

A better understanding of the construction of the present invention novel adapter 10 can be realized by an examination of FIGS. 2A, 2B, 3A and 3B. FIG. 2A is an end view of the adapter 10 showing the male connector end 16. The tabs 24 in an "ON" position and the tabs 28 in an "OFF" position are shown on the top surface, or the top cover 12 of the adapter 10. The retractable pins 20 which are not shown in FIGS. 1A and 1B are shown in FIG. 2A. For the 25-pin male connector of FIG. 1A, a total of 25 pins 20 are illustrated which are enclosed by a metal fence 30. Similarly, the tabs 34 in the "ON" position and the tabs 38 in the "OFF" position shown on the bottom cover 32 of the adapter 10 are shown in FIGS. 1B and 2A. It should be noted that, for a standard size RS232 connector, a width of 3.1 cm is maintained for the width of the adapter 10.

Figure 2B:
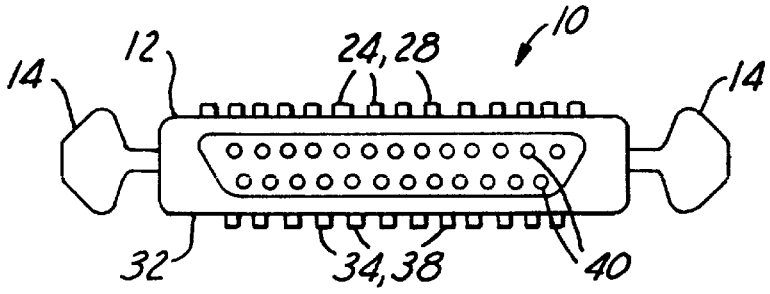
FIG. 2B is an end view of the present invention universal adapter showing 25 sockets.

FIG. 2B is an end view of the adapter 10 showing the end 18 and the 25 sockets 40. It should be noted that, as shown in FIGS. 2A and 2B, the tabs 24, 28 are used to operate the top row of retractable pins 20, while the tabs 34, 38 art used to operate the bottom row of retractable pins 20. The operating modes of the tabs 24, 28, 34, 38 of the retractable pins 20 are more clearly illustrated in FIGS. 3A and 3B.

Figure 3A:
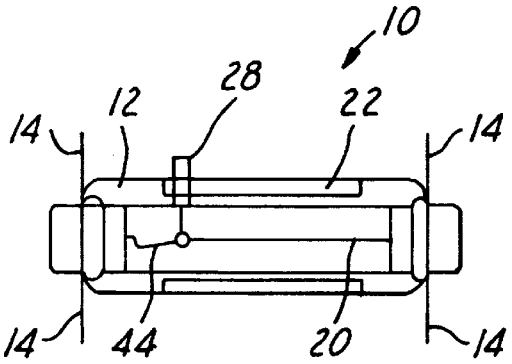
FIG. 3A is a cross-sectional view of the present invention universal adapter with the tab in an OFF position and the retractable pin retracted.
Figure 3B:
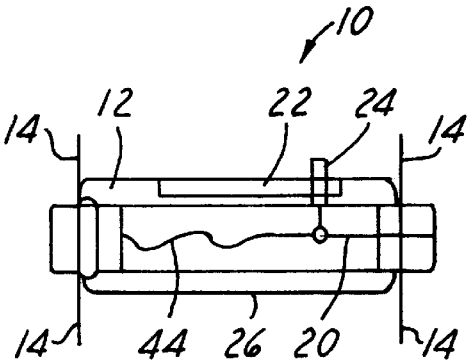
FIG. 3B is a cross-sectional view of the present invention universal adapter with the tab in an ON position and the retractable pin extended.

Referring now to FIG. 3A wherein the present invention universal adapter 10 is shown in a cross-sectional view. The tab 28, corresponding to the tabs of the same numeral in FIG. 1A, positions the retractable pin 20 in an "OFF" position or in a fully retracted position. The tab 28 moves in a slot opening 22 that is provided on the top over 12 of the adapter 10. A conductive wire 44 is provided for establishing electrical communication between the retractable pin 20 and a socket (not shown) in the opposite end of the adapter 10. When the tab is in an "ON" position, as shown in FIGS. 1A and 3B, the retractable pin 20 is pushed by the tab 24 in the slot opening 22 to a fully extended position such that the pin 20 extends outside of the adapter housing 26. This allows the retractable pin 20 in a "ready-for-connection" position to establish electrical communication with a female connector, i.e., with a socket in a female connector.

It should be noted that the present invention novel adapter 10 may further be provided with a frictional engagement device for the retractable pins 20. The frictional engagement device enables the retractable pin to stay securely either in the retracted position as shown in FIG. 3A, or in the fully extended position as shown in FIG. 3B. The frictional engagement means is desirable such that a fully extended retractable pin 20 can be inserted into a socket in a female connector without being pushed back into an "OFF" position, i.e., from FIG. 3B to FIG. 3A. The frictional engagement means may be suitably provided by a pad of a felt material that surrounds the retractable pin for providing the necessary frictional engagement.

The present invention novel apparatus and the method for utilizing such apparatus have therefore been amply demonstrated in the above descriptions and in the appended drawings of FIGS. 1A~3B. While a 25-pin connector is illustrated for the present invention, any other suitable number of pins in the connector may also be used for achieving the same desirable result of the present invention.

While the present invention has been described in an illustrative manner, it should be understood that the terminology used is intended to be in a nature of words of description rather than of limitation.

Furthermore, while the present invention has been described in terms of a preferred and an alternate embodiment, it is to be appreciated that those skilled in the art will readily apply these teachings to other possible variations of the inventions.

The embodiment of the invention in which an exclusive property or privilege is claimed are defined as follows:

1. A universal adapter equipped with retractable pins comprising:

a housing having a cavity therein for holding n pins at one end and n sockets at an opposite end, at least n slot openings provided in said housing corresponding to the positions of said n pins, n tabs each connected to one of said n pins slidably and non-pivotably engaging one of said at least n slot openings such that at least one of said n pins is extended for making electrical connection with at least one socket in a female connector or retracted into said housing for breaking connection with said at least one socket in said female connector, and at least one electrical conductor connecting at least one of said n pins to at least one of said n sockets in said opposite end of said housing.

2. A universal adapter equipped with retractable pins according to claim 1, wherein n is 15 and said adapter connects to a 15-socket female connector.

3. A universal adapter equipped with retractable pins according to claim 2, wherein said adapter connects to a 9-socket female connector.

4. A universal adapter equipped with retractable pins according to claim 1, wherein said n is 25 and said housing holds 25 pins in said housing.

5. A universal adapter equipped with retractable pins according to claim 1, wherein said adapter connects to a 25-socket female connector.

6. A universal adapter equipped with retractable pins according to claim 1, wherein said adapter connects to a 15-socket female connector.

7. A universal adapter equipped with retractable pins according to claim 1, wherein said adapter connects to a 9-socket female connector.

8. A universal adapter equipped with retractable pins according to claim 1, wherein said housing having a front cover and a back cover defining a cavity contained therein.

9. A universal adapter equipped with retractable pins according to claim 8, wherein said n slot openings are provided in said front cover of said housing.

10. A universal adapter equipped with retractable pins according to claim 8, wherein said n slot openings are provided in said back cover of said housing.

11. A universal adapter equipped with retractable pins according to claim 8, wherein said n slot openings are provided in both said front and said back cover of said housing.

12. A method for connecting a male connector having n pins to a female connector having m sockets where n is larger than m comprising the steps of:

providing an adapter comprising housing having a cavity therein adapted for holding n pins at one end and n sockets at an opposite end, at least n slot openings provided in said housing corresponding to the positions of said n pins, n tabs each connected to one of said n pins slidably and non-pivotably engaging one of said at least n slot openings such that at least one of said n pins being extended for making electrical connection with at least one socket in a female connector or retracted into said housing breaking connections with said at least one socket in said female connector, at least one electrical conductor connecting at least one of said n pins to at least one of said n sockets in said opposite end of said housing, and retracting into said housing of said adapter at least one of said n pins such that said female connector is inserted to intimately engage said end of the housing having n pins wherein at least one of said n pins engages at least one of said m sockets.

13. A method for connecting a male connector having n pins to a female connector having m sockets where n is larger than m according to claim 12, wherein n is 25 and said housing being adapted for holding 25 pins in said housing.

14. A method for connecting a male connector having n pins to a female connector having m sockets where n is larger than m according to claim 13, wherein said adapter connects to a female connector having less than 25 sockets.

15. A method for connecting a male connector having n pins to a female connector having m sockets where n is larger than m according to claim 13, wherein said adapter connects to a 15-socket female connector.

16. A method for connecting a male connector having n pins to a female connector having m sockets where n is larger than m according to claim 13, wherein said adapter connects to a 9-socket female connector.

17. A method for connecting a male connector having n pins to a female connector having m sockets where n is larger than m according to claim 12, wherein said n is 15 and said adapter connects to a female connector having less than 15 sockets.

18. A method for connecting a male connector having n pins to a female connector having m sockets where n is larger than m according to claim 12, wherein said n is 15 and said adapter connects to a female connector having 9 sockets.

19. A method for connecting a male connector having n pins to a female connector having m sockets where n is larger than m according to claim 12 further comprising the step of providing n slot openings in a front cover of said housing.

20. A method for connecting a male connector having n pins to a female connector having m sockets where n is larger than m according to claim 12 further comprising the step of providing n slot openings in both a front cover and a back cover of said housing.

21. A method for connecting a male connector having n pins to a female connector having m sockets where n is larger than m according to claim 12 further comprising the step of equipping said n tabs with frictional engagement means for holding said at least one of n pins extended in place for inserting into a female socket.

22. A method for connecting a male connector having n pins to a female connector having m sockets where n is larger than m according to claim 12 further comprising the step of equipping said n tabs with frictional engagement means for holding said at least one of n pins retracted in place and not making electrical connection.

* * * * *